United States Patent [19]

Lamy

[11] 4,019,332

[45] Apr. 26, 1977

[54] DEVICES FOR PROTECTING THE BASES OF STRUCTURES IMMERSED IN A VOLUME OF WATER AGAINST UNDERMINING

[75] Inventor: Jacques Edouard Lamy, Fontenay-aux-Roses, France

[73] Assignee: C. G. Doris, Paris, France

[22] Filed: Dec. 24, 1975

[21] Appl. No.: 644,153

[30] Foreign Application Priority Data

Dec. 31, 1974 France ..... 74.43434

[52] U.S. Cl. ..... 61/86; 61/3; 61/4

[51] Int. Cl.[2] ..... E02B 3/04

[58] Field of Search ..... 61/3, 4, 2, 1, 46, 46.5, 61/86, 87

[56] References Cited

UNITED STATES PATENTS

| | | | |
|---|---|---|---|
| 3,738,113 | 6/1973 | Madary et al. | 61/46.5 |
| 3,886,753 | 6/1975 | Birdy et al. | 61/46.5 |

*Primary Examiner*—Jacob Shapiro
*Attorney, Agent, or Firm*—Laurence R. Brown

[57] ABSTRACT

A device for protecting the base of a structure resting or constructed on the bed of a body of water against undermining, comprising a curtain which extends without interruption parallel to the base of the structure at a certain distance therefrom in the direction of the body of water, characterized in that said curtain is an imperforate wall extending from the ground upward to a height which is but a minor fraction of the depth of the body of water whereby the whole of the wall is deeply immersed in the water.

10 Claims, 5 Drawing Figures

DEVICES FOR PROTECTING THE BASES OF STRUCTURES IMMERSED IN A VOLUME OF WATER AGAINST UNDERMINING

This invention relates to structures constructed or resting on the bed of a body of water, such as breakwaters or marine installations such as reservoirs, platform structures for exploring for or exploiting sub-marine wealth or for supporting scientific or meteorological installations, and its object is to create an arrangement which protects the base of such a structure against undermining caused by swell or by sub-aquatic currents.

In U.S. Pat. No. 3,878,684 assigned to the same assignee, are described devices aimed to achieve this result by encouraging the establishment of currents directed towards the installation in the zone at the base thereof and returning towards the open body of water in a zone at a higher level. To this effect, a perforated curtain is constructed close to the base of the installation and is so arranged that the water currents flowing through the perforated curtain experience asymmetrical pressure drops according to the direction of traverse, or else a perforated wall which is completely immersed and above which the currents pass in returning towards the body of free water. One thus reverses the tendency towards undermining which one habitually observes in marine installations, and a tendency to bank-up at the base of the structure.

The applicant has discovered during the course of its studies that one can also obtain a banking-up effect by constructing at a suitable distance from the base of the structure, an imperforate wall of small height, which is completely immersed. The present invention relates to such an arrangement.

Figure 1:
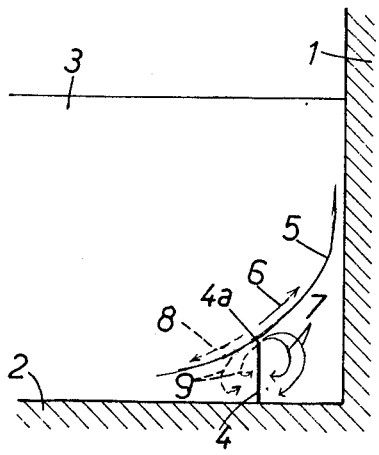
FIG. 1 is an explanatory scheme which has been referred to in the introduction of the present description.

One can attempt to explain this banking-up effect in the following way but it goes without saying that the invention should not be limited by any theory or scientific hypothesis. FIG. 1 of the annexed drawings is a schematic vertical section of a structure 1 constructed on the bed 2 of a body of water 3 submitted to a swell which develops facing the structure, in front of which is constructed an imperforate protecting wall 4. The swell produces at depth, in front of the structure 1, currents which alternately bring the molecules of water towards and away from the structure and which are diverted by the wall 4 following trajectories practically tangential to the front surface of the structure 1, as shown schematically at 5. The ridge of the top 4*a* of the wall causes, under the action of advancing currents 6 and returning currents 8 respectively, eddies 7 and 9 which flow around this ridge, and the movement of water created by the eddies 9 in front of the wall 4 will tend, if it reaches the level of the bed 2, to bring sediments on the bed towards the base of the installation. Experiments on a reduced scale, in a dock subjected to a swell, have furthermore shown that the banking-up effect is produced if the height of the wall is sufficiently small but not if the wall is too high. These experiments have also shown that if the height of the wall and the distance between it and the base of the structure are suitably chosen, the eddies such as 9, generated by the top 4*a* of the wall in the water currents such as 8 descending tangentially to the surface of the structure and diverted by the wall 4, reach the bed 2 of the body of water in the portion of their trajectory which is directed towards the base of the wall, and the banking-up effect is produced.

The protective arrangement according to the present invention thus comprises an imperforate wall the height of which is but a minor fraction of the depth of the body of water and which is constructed parallel to the base of the structure between the latter and the free body of water. The height of the wall and its distance from the base of the structure can be determined, in each particular case, by means of experiments on a reduced scale.

The structure to be protected and the protective wall are conveniently constructed on a common floor portion. In one embodiment, a structure constructed at a depth of about 25 meters, below the level of lowest water of a sea likely to be subjected to a swell having a height of 9 meters from crest to trough and a period of 9 to 13 seconds, is protected by an imperforate wall 5 meters high constructed 7 meters from the base of the structure.

When the structure has a closed contour, the protective device advantageously comprises a continuous wall constructed completely around the base of the structure. According to one feature of the invention, if the structure to be protected and the protective wall are in addition constructed on a common floor portion, the wall can be connected to the structure by a perforated wall so as to form with the structure a caisson integral therewith, the holes in the perforated wall being capable of being temporarily blocked so that the said caisson forms a buoyancy chamber during the construction of the installation afloat and its towing towards the place of completion or installation, in the manner described in U.S. patent application Ser. No. 461,347 filed Apr. 16, 1974.

For a structure placed on a bed situated about 100 meters below a sea likely to be subjected to a swell of about 10 to 30 meters from crest to trough, the height of the wall should be between about 5 and 15 meters and its distance to the base of the structure should be between about 5 and 15 meters. If the depth of the water is 140 meters, the height of the protective wall should be between about 5 and 15 meters but it should be located about 27 meters from the base of the structure.

According to another feature of the invention, a structure with a closed contour and its protective wall are constructed on a common floor portion which closes in a watertight manner the base of the structure and of the annular space between the base of the structure and the wall. This annular space can thus act as a buoyancy chamber when, after having constructed the floor portion, the wall and a lower part of the structure in a dry dock, the construction of the structure is completed afloat. It is then advantageous to give the wall a height such that its top does not reach the surface of the water before the constructed part of the structure has a height sufficient for it to form a buoyancy chamber capable of supporting the weight of the assembly. In the above examples of a structure designed to rest at depths of 100 to 140 meters, one would then preferably select a wall height of about 15 meters.

In the case of a wall surrounding a structure of closed contour, the wall can advantageously have an irregular height, for example a height alternately increasing and decreasing so that the top of the wall forms festoons. One thus encourages, in the regions near the ends of the wall diameter of the perpendicular to the direction of propagation of the swell, the formation of currents which are diverted alternately centripetally and centrifugally to generate eddies producing a banking-up effect.

Figure 2:
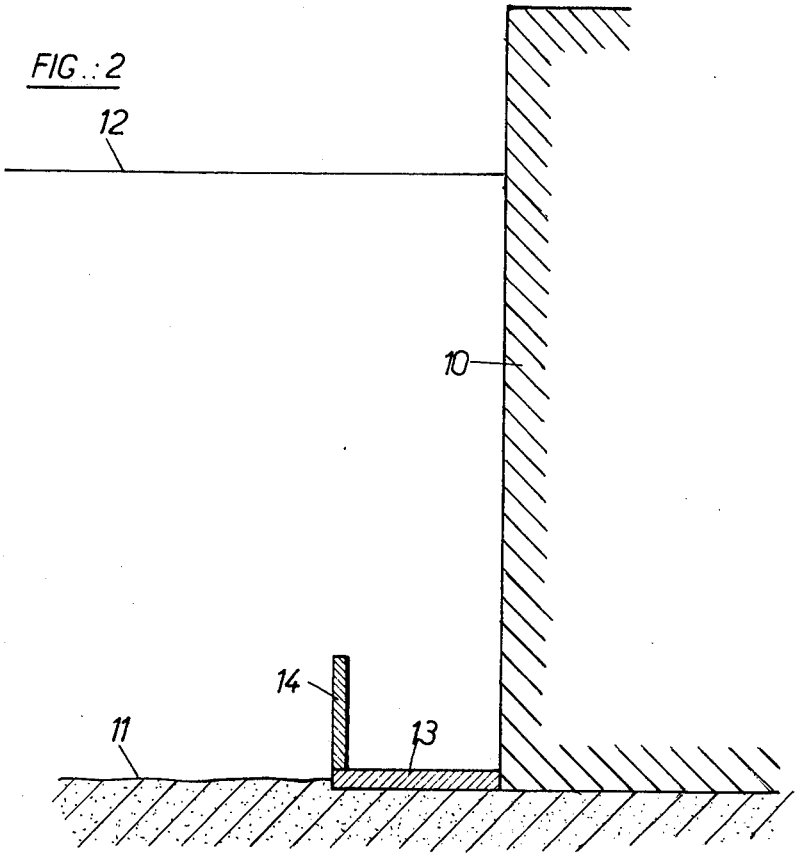
FIG. 2 is a transverse section of a part of an installation comprising a protective wall according to the invention.

FIG. 2 shows the front part of a massive structure 10, being for example a breakwater, constructed on the bed 11 of a sea of which the surface at lowest water shown at 12 is about 25 meters above the bed 11. The swells observed in bad weather at the location of this structure have an average height of the order of 9 meters, measured from crest to trough, and a period of 9 to 13 seconds. The base of the structure 10 is extended in the direction of the sea by a slab 13 resting on the bed 11 and on which is constructed a wall 14 having a height of 5 meters and located 7 meters from the structure.

Figure 3:
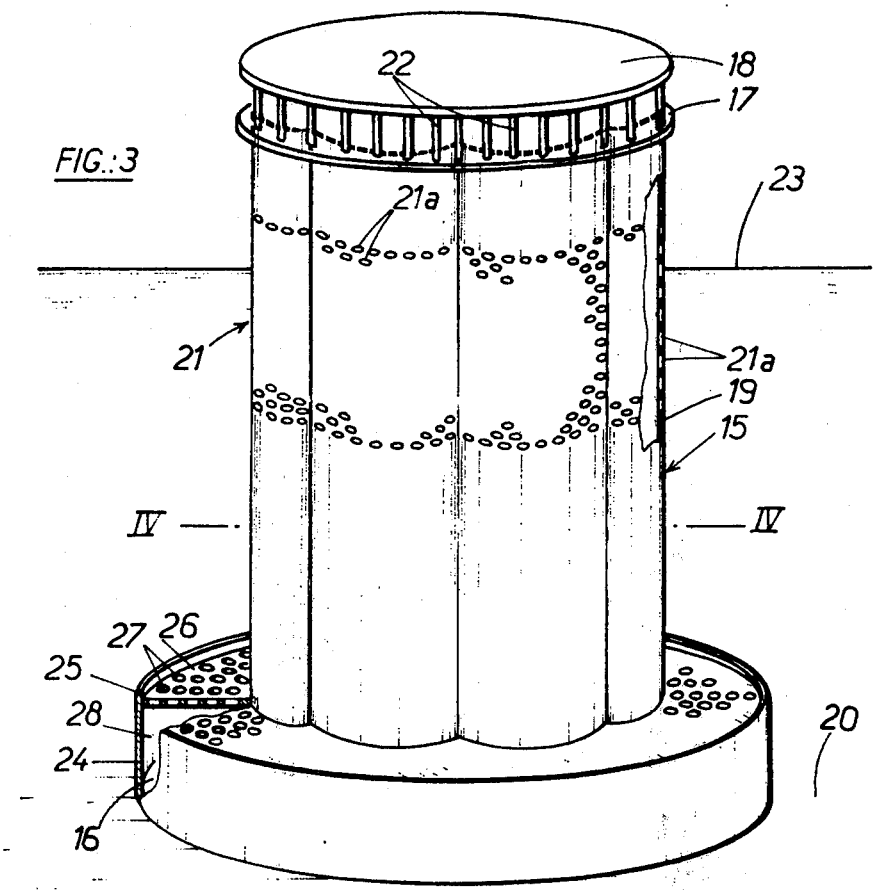
FIG. 3 shows a structure with closed contour provided with a protective device according to the invention. to form a caisson, being a part-sectioned perspective view on the line III—III of FIG. 4.
Figure 4:
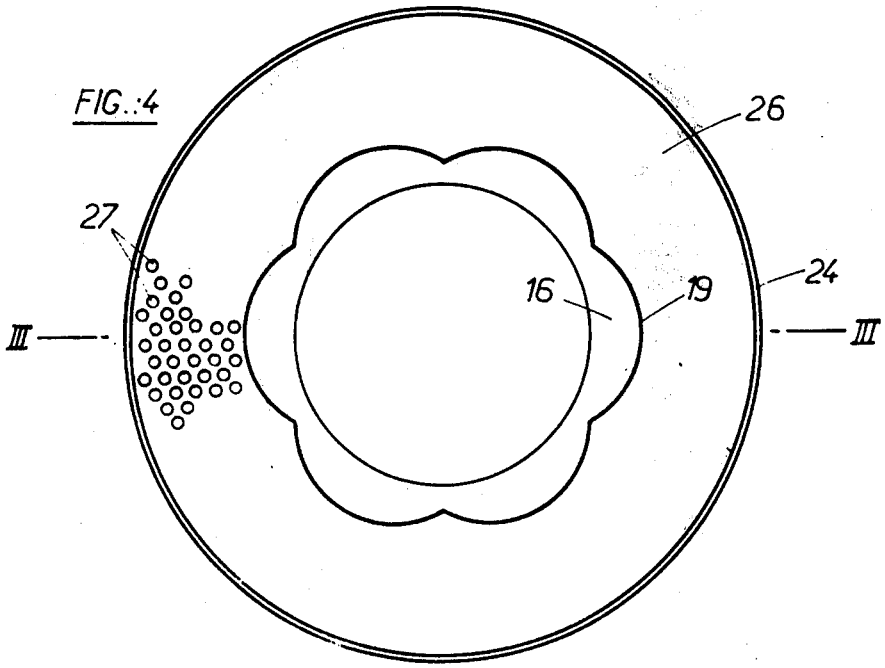
FIG. 4 is a section on the line IV—IV of FIG. 3.

FIGS. 3 and 4 show a structure in the form of a lobed tower 15 constructed on an annular floor portion 16 and supporting a platform with two decks 17 and 18 designed to support marine installations, for example installations for searching for or exploiting submarine hydrocarbon deposits, or scientific or meteorological installations. The structure 15 has a lobed wall 19 of a geometric form having six vertical cylindrical portions which intersect along generatrix. This wall 19 is sufficiently thick or reinforced by bracing (not shown) to enable it to support in a stable manner the decks 17, 18 of the platform and the installations (not shown) arranged on the decks, when the floor portion 16 rests on the bed of the sea 20 in FIG. 3. A portion 21 of the wall 19, located between the levels of high and low water at the place where the structure is to be located, is pierced with holes 21*a* designed to reduce the pressure applied to the structure by the impact of the swell. The deck 17 rests on the top of the wall 19 and supports the deck 18 by way of a plurality of posts 22. The level of the water at a given moment is shown for example at 23.

On the floor portion 16 there is constructed, completely around the base of the wall 19, a circular imperforate wall 24 which is connected to the wall 19, a little below its top 25, by a horizontal wall 26 pierced with holes 27. By way of example, if the structure is designed to be installed at depths of the order of 20 to 30 meters, at locations where the swell can reach a height of ten meters from crest to trough, the wall 24 should, as in the embodiment of FIG. 2, have a height of the order of 5 meters and should be spaced about 6 to 7 meters from the wall 19.

Means (not shown) such as obturating devices of the kind described in the above-mentioned U.S. patent application Ser. No. 461,347, the specification of which is held to be a part of the present description, are provided to temporarily close the holes 27 so that the wall 26 forms with the wall 24 and the floor portion 16 a watertight caisson surrounding the base of the structure and integral therewith, thus being able to act as a buoyancy chamber during the completion of the construction of the structure and during its towage, in a manner also described in said patent application, whereafter one opens the obturating devices to flood the caisson 28 and cause the structure to descend to the bed. One can then secure the structure by any convenient means to ensure its retention on the bed.

Figure 5:
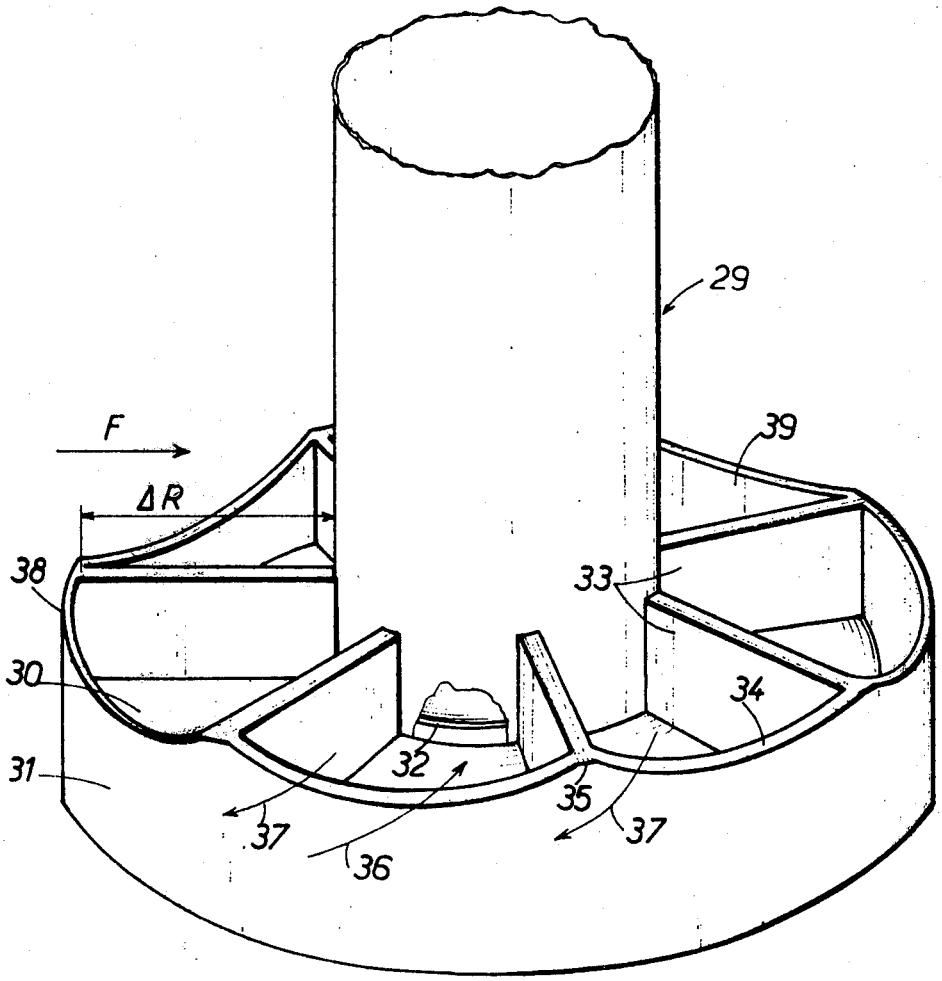
FIG. 5 is a perspective view, partly broken away, of the lower part of an installation designated to rest at a depth of 100 meters or more.

FIG. 5 shows the lower part of a structure in the form of a tower 29 designed to be installed at great depth for supporting above the surface of the sea a platform similar to that of FIG. 3. This structure is provided at its base with a floor portion comprising, outside the tower 29, an annular slab 30 on which is constructed the protective wall 31 and, inside the tower, a slab 32 which is at a higher level than the annular slab 30 so as not to bear on the submarine floor so as to increase the compression stress of the latter under the annular slab 30; the floor is thus in compression over the whole of its surface in contact with the annular slab 30, and one thus avoids any lifting of the latter under the action of rocking couples applied to the structure.

The wall 31 is connected to the wall of the tower 29 by a plurality of radially disposed vertical ribs 33 which effect a very strong reinforcement of the lower section of the tower constituted by the floor portion and the wall 31. This lower section ensures that the tower 29 has a very large foundation on the sea bed which gives it very great stability. The height of the wall 31 is not constant around its periphery, its top forming a plurality of festoons or concave curves 34 of which the peaks 35 are located at the ends of the ribs 33.

When the structure rests on the bed of a sea agitated by a swell which is propagated in the direction of the arrow F, the portions of the top of the wall 31 situated near a diametral plane perpendicular to the direction of the arrow F divert the currents produced by the swell to form alternatively currents 36 diverted centripetally and currents 37 diverted centrifugally which come and go over the top of the wall in the same manner as the currents diverted by the wall in the frontal region 38 and which thus produce a banking-up effect.

The structure is designed to be placed on a sea bed at 100 meters or more below the surface of a sea likely to be subjected to a swell of 10 to 30 meters in height, from crest to trough, and the wall 31 has a height between about 12 meters (at the bases of the concave curves or festoons 34) and about 15 meters (at the peaks 35). The radial distance $\Delta R$ between the tower 29 and the wall 31 will be of the order of 18 meters if the depth of the bed on which the structure rests is of the order of 100 meters. This distance $\Delta R$ will be of the order of 27 meters if the depth is of the order of 140 meters.

The interior volume of the tower 29 is closed in a watertight manner at its base by a slab 32, and the annular span 39 between this tower and the wall 31 (an annular span which is divided into compartments by the ribs 33) is closed in a watertight manner at its base by the slab 30. The construction of the structure is carried out in a manner similar to those described in U.S. patent application Ser. No. 491,570 filed July 24, 1974 and French Pat. No 73 36473.

After having built in a dry dock the wall 31 and a part of the tower 29 resting on the floor portion, one launches the part of the structure thus created and tows it to a sheltered place of sufficient depth where one continues the construction afloat. During a first phase of the construction afloat, the structure is supported by the buoyancy chamber constituted by the interior volume of the tower and the annular space 39 and, as construction proceeds, this buoyancy chamber sinks lower in the water. There comes a time where the water level reaches the bases of the festoons 34; the water thus enters the annular space 39 so that immersion increases abruptly. It is necessary to ensure that in the course of construction, the structure does not sink in the water as far as the top of the constructed part of the tower which should therefore have a sufficient buoyancy and therefore a sufficient height. As can be verified by a simple calculation, the height of the constructed part of the tower is a function increasing linearly with the height of the bases of the festoons above the floor portion.

In other words, if one calls the "base section" of the tower 29 the section which extends upwards from the annular slab 30 to the level of the bases of the festoons 34, the "intermediate section" the section which extends above the base section as far as the level of what is called above the top of the constructed part of the tower, and the "upper section" the section which is supported by the intermediate section and which extends above the surface of the body of water, the structure in the course of construction will sink in the water as far as the top of the constructed part of the tower if the displacement of the vessel formed by the slab 32, the base section and the intermediate section is equal in weight to the structure already constructed (comprising the floor portion, the wall, the base section and the intermediate section). To avoid the structure sinking during the course of construction, it is therefore necessary that the wall 31 has a height such that the displacement of the vessel formed by the floor portion, the base section and the wall should be at least equal to the weight defined above.

It is for this reason that it is advantageous to fix this height at about 15 meters, although it would be sufficient to fix it in the region of 5 meters to obtain the desired banking-up effect.

It will thus be seen that the combination of the tower 29 with the wall 31 resting on the floor position and connected to the tower by the ribs 33, produces three advantageous effects i.e. the protection of the base of the tower against undermining, an improvement in its stability when it is resting on the bed, and an increase in its buoyancy during its construction afloat.

I claim:

1. A combination for protecting the base of a structure having a base resting on the bed of a body of water with sub-aquatic currents against undermining by the effect of said currents, comprising, a continuously vertically extending member in said structure reaching a predetermined height above said bed, an imperforate wall extending without interruption substantially parallel to the vertically extending member of the structure at a distance from said vertically extending member in the direction of the body of water to thereby intercept said currents in the direction toward and away from said member, and providing a space between the top of the wall and the member free of obstacles which would prevent water from entering that space thereby to permit said sub-aquatic water currents to induce water currents reaching the bed of said body of water in that space, said imperforate wall reaching from the bed of the body of water to a height which is but a minor fraction of the depth of the body of water and said height of said member whereby the entirety of the wall is deeply immersed in the water.

2. A device as claimed in claim 1, comprising a floor portion integral with the base of the structure and the wall.

3. A device as claimed in claim 1, in which the base of the structure has a closed contour and the wall surrounds the base of the structure in radially spaced relation thereto.

4. A device as claimed in claim 3, comprising a continuous slab extending radially all around the base of the structure for supporting the base of the structure and the wall, whereby the wall forms around the base of the structure an annular caisson integral with the structure and bottomed by the slab, the said slab being designed for engaging through its lower surface the bed of the body of water to seat the installation thereon, an upper annular perforated wall for roofing the annular caisson, said perforated wall having a multiplicity of holes formed therethrough for the passage of water, and optionally releasable valve means for selectively plugging said holes watertightly to transiently prevent the passage of water therethrough so long as said valve means are not voluntarily released from said holes.

5. A device as claimed in claim 3, comprising a floor portion integral with the base of the structure and wall, and a plurality of ribs disposed radially for connecting the wall to the structure.

6. A device as claimed in claim 3, in which the wall varies in height.

7. A device as claimed in claim 6, in which the wall has a height which alternately increases and decreases in such manner that the top of the wall is festooned.

8. A device as claimed in claim 1, for the protection of the base of a structure resting on the bed of a body of water having a depth of about 25 meters and likely to be subjected to a swell of a height between crest and trough of about 10 meters, in which the height of the wall is about 5 meters and the distance from the wall to the base of the structure is about 7 meters.

9. A device as claimed in claim 1, for the protection of the base of a structure resting on the bed of a body of water having a depth of the order of 100 meters and likely to be subjected to a swell having an amplitude from crest to trough in the range of about 10 to about 30 meters, in which the height of the wall is in the range of about 5 meters to about 15 meters and the distance of the wall from the base of the structure is about 18 meters.

10. A device as claimed in claim 1, for the protection of the base of a structure resting on the bed of a body of water having a depth of about 140 meters and likely to be subjected to a swell having an amplitude from crest to trough in the range of about 10 meters to about 30 meters, in which the height of the protecting wall is in the range of about 5 meters to about 15 meters and the distance of the wall from the base of the structure is about 27 meters.

* * * * *